US011806594B1

(12) United States Patent
Pitre

(10) Patent No.: US 11,806,594 B1
(45) Date of Patent: Nov. 7, 2023

(54) GOLF BALL MARKER

(71) Applicant: Robert Pitre, Dallas, TX (US)

(72) Inventor: Robert Pitre, Dallas, TX (US)

(73) Assignee: Robert Pitre, Dallas, TX (US)

( * ) Notice: Subject to any disclaimer, the term of this patent is extended or adjusted under 35 U.S.C. 154(b) by 0 days.

(21) Appl. No.: 18/306,146

(22) Filed: Apr. 24, 2023

(51) Int. Cl.
*A63B 57/30* (2015.01)
*A63B 71/06* (2006.01)
*A63B 102/32* (2015.01)

(52) U.S. Cl.
CPC ..... *A63B 57/353* (2015.10); *A63B 71/0622* (2013.01); *A63B 2071/0694* (2013.01); *A63B 2102/32* (2015.10)

(58) Field of Classification Search
CPC ..... A63B 57/353; A63B 71/0622
See application file for complete search history.

(56) References Cited

U.S. PATENT DOCUMENTS

| | | | | |
|---|---|---|---|---|
| 5,582,554 | A | 12/1996 | Stryczek | |
| 6,386,995 | B1 * | 5/2002 | Jastram | A63B 57/207 473/406 |
| 6,394,916 | B1 * | 5/2002 | Doucettperry | A63B 57/207 473/285 |
| 6,890,273 | B1 | 5/2005 | Perez | |
| 8,992,345 | B2 * | 3/2015 | Peterson | A63B 57/353 463/46 |
| 9,839,828 | B2 | 12/2017 | Leech et al. | |
| 2005/0101415 | A1 | 5/2005 | Sweeney | |
| 2008/0207356 | A1 | 8/2008 | Pekrol | |
| 2015/0182836 | A1 * | 7/2015 | Freeman | G06V 40/23 473/406 |
| 2018/0345101 | A1 * | 12/2018 | Youn | A63B 57/35 |
| 2023/0176022 | A1 * | 6/2023 | Ito | G01N 33/0006 73/1.06 |

FOREIGN PATENT DOCUMENTS

| | | | |
|---|---|---|---|
| JP | H0549720 | A * | 3/1993 |
| KR | 100715624 | B1 * | 5/2007 |
| KR | 101642688 | | 7/2016 |
| KR | 200487839 | | 11/2018 |
| KR | 20190086336 | A * | 7/2019 |
| KR | 102148254 | B1 * | 8/2020 |
| KR | 2239061 | B1 * | 4/2021 |
| KR | 102304787 | B1 * | 9/2021 |
| KR | 20220026631 | A * | 3/2022 |
| KR | 20220138033 | A * | 10/2022 |
| KR | 20230060728 | A * | 5/2023 |
| WO | WO-2020226287 | A1 * | 11/2020 |

* cited by examiner

*Primary Examiner* — Steven B Wong
(74) *Attorney, Agent, or Firm* — Scott Griggs; Griggs Bergen LLP

(57) ABSTRACT

A golf ball marker is disclosed. In one embodiment, an upper display is visible at an upper surface of the golf ball marker and a lower display is visible at a lower surface thereof. The golf ball marker may display various data on upper display and the lower display, such as a temperature reading from a temperature sensor, a slope reading from an inclinometer, a direction associated with a slope reading, and a humidity reading from a humidity sensor.

15 Claims, 2 Drawing Sheets

GOLF BALL MARKER

TECHNICAL FIELD OF THE INVENTION

This invention relates, in general, to golf and, in particular, to a golf ball marker used to mark the position of a golf ball on a putting green, for example.

BACKGROUND OF THE INVENTION

Golf ball markers are typically small, flat objects utilized during play of a round of golf. When a golfer's ball is in the way of another player's shot or needs to be moved to avoid damage or interference, a golf ball marker may be utilized to mark the position of the golf ball before lifting the golf ball off the green. This allows a player to pick up the golf ball, clean it, and replace the golf ball with a high degree of precision in the position marked by the golf ball marker, without the need to measure or guess the original position. While golf ball markers come in many shapes, sizes, and designs, technological improvements are needed to provide enhanced features.

SUMMARY OF THE INVENTION

It would be advantageous to achieve a golf ball marker that would conveniently mark the position of a golf ball with enhanced features. It would also be desirable to enable an electro-mechanical-based solution that would be non-encumbering. To better address one or more of these concerns, in one aspect of the invention, a golf ball marker is disclosed. As will be appreciated from the discussion below, in some embodiments, an upper display is visible at an upper surface of the golf ball marker and a lower display is visible at a lower surface thereof. The golf ball marker may display various data on the upper display and the lower display, such as a temperature reading from a temperature sensor, a slope reading from an inclinometer, a direction associated with a slope reading, and a humidity reading from a humidity sensor, for example. These and other aspects of the invention will be apparent from and elucidated with reference to the embodiments described hereinafter.

BRIEF DESCRIPTION OF THE DRAWINGS

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the present invention.

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

Figure 1:
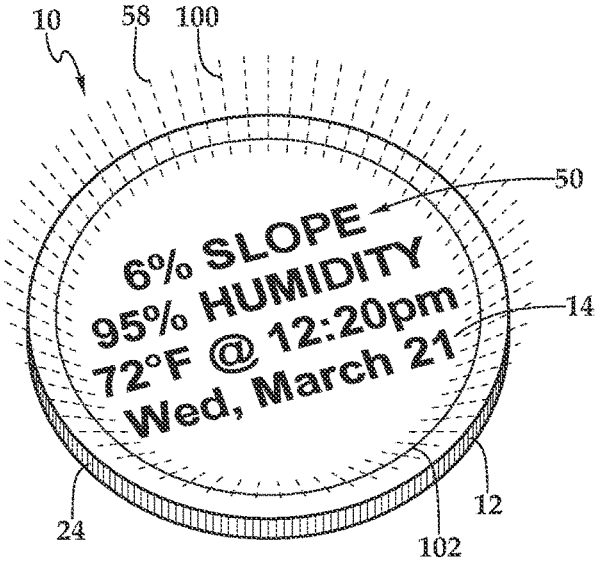
FIG. 1 is a perspective view of one embodiment of a golf ball marker, according to the teachings presented herein.
Figure 2:
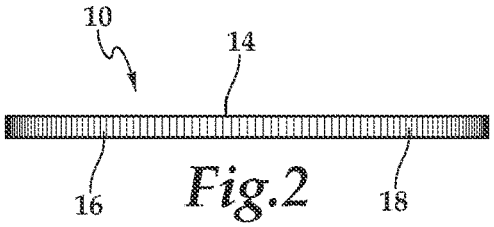
FIG. 2 is a front elevation view of the golf ball marker presented in FIG. 1.
Figure 3:
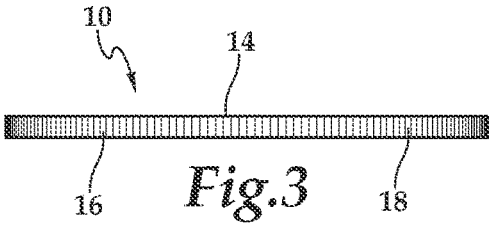
FIG. 3 is a rear elevation view of the golf ball marker presented in FIG. 1.
Figure 4:
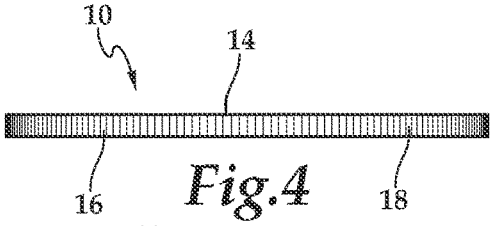
FIG. 4 is a side elevation view of the golf ball marker presented in FIG. 1.
Figure 5:
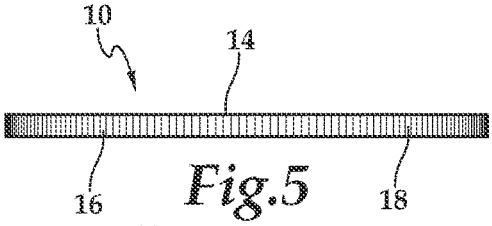
FIG. 5 is also a side elevation view of the golf ball marker presented in FIG. 1.
Figure 6:
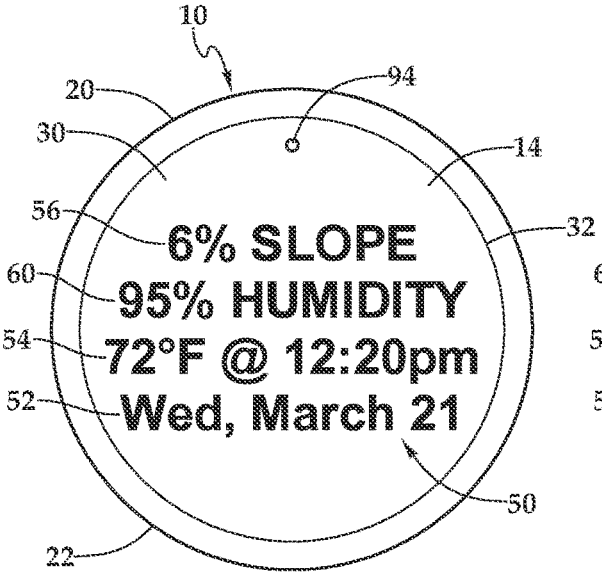
FIG. 6 is a top plan view of the golf ball marker presented in FIG. 1.
Figure 7:
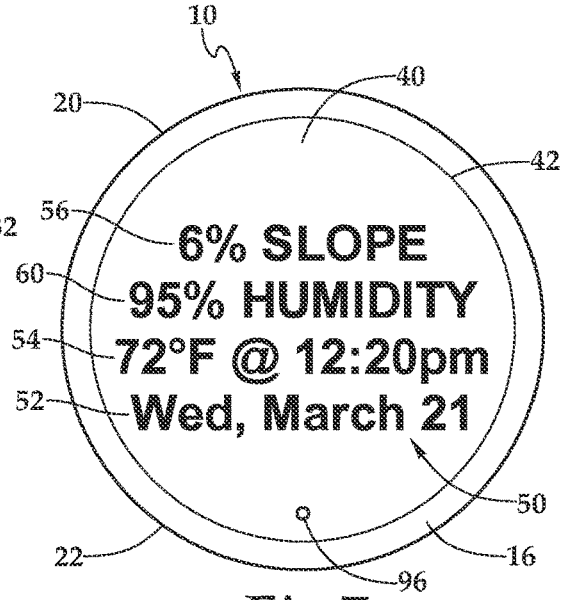
FIG. 7 is a bottom plan view of the golf ball marker presented in FIG. 1.

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the present invention.

Referring initially to FIG. 1 through FIG. 7, therein is depicted a golf ball marker that conveniently marks the position of a golf ball with an enhanced feature set, that is schematically illustrated and generally designated 10. In some embodiments of the golf ball marker 10, a housing 12 includes an upper surface 14, a lower surface 16, and a sidewall 18 interposed therebetween. As shown, in some embodiments, the housing 12 may have a disc shape 20 with a flush finish 22 that has all elements being within the disc shape 20 of the housing 12. Reeds 24 provide grooved edges around the housing to improve tactile handling of the golf ball marker 10. An upper display 30 is integrated into the housing 12 such that the upper display 30 is visible at the upper surface 14. As depicted, the upper display 30 includes an upper perimeter 32. Similarly, a lower display 40 is integrated into the housing 12 such that the lower display 40 is visible at the lower surface 16, which includes a lower perimeter 42.

The golf ball marker 10 may display various data 50 on at least one of the upper display 30 and the lower display 40. By way of example and not by way of limitation, such data 50 may include date and/or time 52, a temperature reading 54, a slope reading 56, a direction 58 associated with the slope reading 56, and a humidity reading 60. With respect to data 50 that includes date and/or time 52, as golf rounds can take several hours, it is important to keep track of time to ensure that players finish their round in a timely manner. By having the date and/or time 52 displayed on the golf ball marker 10, golfers may quickly glance at the upper display 30 or the lower display 40 to check the time and keep their pace of play on track.

Golfers may also want to keep a record of when and where a specific round was played, especially if it was a particularly memorable one or if the golfer achieved a personal milestone. By having the date and/or time 52 displayed on the golf ball marker 10, the golfer may easily note this information for future reference. With respect to the temperature reading 54 and the humidity reading 60, the golf ball marker 10 presented herein may assist with adjusting club selection. Golfers often choose their clubs based on the distance they need to hit the golf ball, but temperature and/or humidity may affect the flight and distance of the ball or the putting distance and path of the golf ball. By having the temperature reading 54 and/or humidity reading 60 displayed on the golf ball marker 10, golfers can adjust club selection and swing accordingly to compensate for the temperature and/or humidity.

In golf, the slope of the green can have a significant impact on the trajectory and roll of the golf ball. By having the slope reading 56 on the golf ball marker 10, golfers can accurately measure the slope of the green and adjust putts accordingly. By way of further explanation, when putting on an uneven surface, golfers may find putting challenging with respect to the correct alignment. By having the slope reading 56 on the golf ball marker 10, golfers can ensure that they are lining up their putts consistently and correctly, which can improve their chances of making the putt. Further to this point, the slope reading 56 on the golf ball marker 10 can help golfers plan their strategy more effectively. By measuring the slope of the green on different parts of the course, golfers can determine which shots require more loft, which require more spin, and which require a more aggressive approach.

In this respect, the slope reading 56 may be a slope percentage that refers to the steepness of the slope on the green or fairway. A steeper slope can make it more challenging for the golfer to make an accurate shot, as it may affect the golf ball's speed and trajectory. The direction 58, as alluded to, refers to the direction in which the slope is running. Knowing the direction 58 can help the golfer determine how to aim a shot, as the slope may affect the golf ball's movement in a particular direction.

Figure 8:
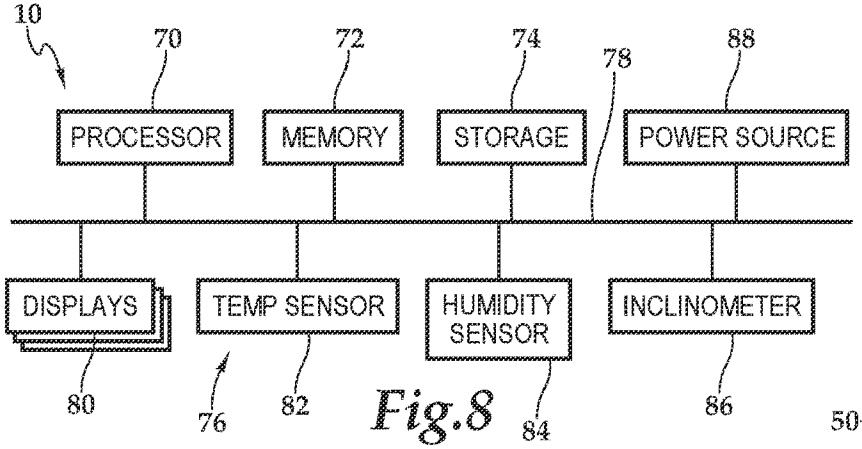
FIG. 8 is a functional block diagram depicting one embodiment of the golf ball marker presented in FIG. 1.

FIG. 8 depicts one embodiment of the golf ball marker 10 showing computer device functionality. Within the housing 12, a processor 70, memory 72, storage 74, and circuitry 76 are interconnected by a bus architecture 78 within a mounting architecture. The processor 70 may process instructions for execution within the golf ball marker 10, including instructions stored in the memory 72 or in the storage 74. The memory 72 stores information within the golf ball marker 10. In one implementation, the memory 72 is a volatile memory unit or units. In another implementation, the memory 72 is a non-volatile memory unit or units. The storage 74 provides capacity that is capable of providing mass storage for the golf ball marker 10. The circuitry 76 may include one or more displays 80, such as the upper display 30 and the lower display 40, a temperature sensor 82, a humidity sensor 84, and an inclinometer 86. A power source 88, such as a battery or rechargeable battery, provides necessary power.

The one or more displays 80, such as the upper display 30 and the lower display 40, may be devices utilized to present visual information, such as text. Each of the upper display 30 and the lower display 40 may have a digital presentation mode or an analog presentation mode. The temperature sensor 82 may be a device that measures the temperature of the environment and provides the temperature reading 54. In some embodiments, the temperature sensor 82 may include an upper temperature sensor 90 disposed proximate the upper surface 14 and a lower temperature sensor 92 disposed proximate the lower surface 16. The temperature sensor 82 is capable of measuring both air temperature and ground temperature.

The inclinometer 86 may include a device that measures the angle of tilt or slope of the golf ball marker 10 and provides the slope reading 56 and the direction 58. The inclinometer 86 may utilize an accelerometer or other sensor to detect changes in gravitational forces, for example. The humidity sensor 84 may include a device, such as a hygrometer, that measures the amount of moisture or water vapor at a target location. The humidity sensor 84 may be a capacitive sensor, resistive sensor or thermal sensor. The humidity sensor further comprises an upper humidity sensor 94 disposed proximate the upper surface 14 and a lower humidity sensor 96 disposed proximate the lower surface 16. In some embodiments, the humidity sensor 84 is capable of measuring both air humidity and ground humidity. Measuring ground humidity may be particularly important for determining the moisture on the golf course or green, for example. The moisture or wetness of the golf course or green may be a factor in a golfer's stroke or putt as such a characteristic impacts golf ball speed.

Referring now to FIG. 1 through FIG. 8, the memory 72 and storage 74 are accessible to the processor 70 and include processor-executable instructions that, when executed, cause the processor 70 to execute a series of operations. With respect to the processor-executable instructions, the processor 70 is caused to display a date and time, shown as the date and/or time 52, on the upper display 30 and the lower display 40 as well as display the temperature reading 54 from the temperature sensor 82 on the upper display 30 and the lower display 40. As shown, the date and/or time 52 shows 12:20 pm and the temperature reading 54 shows 72° F. The processor-executable instructions also cause the processor 70 to display the slope reading 56 from the inclinometer 86 on the upper display 30 and the lower display 32, visually indicate the direction 58 associated with the slope reading 56 at the upper perimeter 30 and the lower perimeter 40, and display a humidity reading 60 from the humidity sensor 84 on the upper display 30 and the lower display 40. As illustrated, the slope reading 56 shows a 6% slope with a visual indicator 100 of the direction 58 showing uphill and a visual indicator 102 of the direction 58 showing downhill. That is, the processor-executable instructions are causing the processor 70 to visually indicate with the visual indicator 100 an uphill slope direction associated with the slope reading 56 at the upper perimeter 32 and the lower perimeter 42, and visually indicate with the visual indicator 102 a downhill slope direction associated with the slope reading 56 at the upper perimeter 32 and the lower perimeter 42. The visual indicator 100 and the visual indicator 102 may be visually distinct, such as, for example, different colors of light.

Other processor-executable instructions may be part of the teachings presented herein. By way of example, the processor-executable instructions may further cause the processor 70 to toggle, on the upper display 30 and the lower display 40, between presentation of the date and/or time 52, the temperature reading 54, the slope reading 56, and the humidity reading 60. Additionally, the processor-executable instructions may cause the processor 70 to display, as part of the slope reading 56, at least one of a slope percentage and a slope direction on the upper and lower displays 30, 40. Additionally, still, the processor-executable instructions may cause the processor 70 to display, as part of the slope reading, a slope percentage and a slope direction as separate values on the upper and lower displays 30, 40.

The processor-executable instructions presented hereinabove include, for example, instructions and data which cause a general-purpose computer, special purpose computer, or special purpose processing device to perform a certain function or group of functions. Processor-executable instructions also include program modules that are executed by computers in stand-alone or network environments. Generally, program modules include routines, programs, components, data structures, objects, and the functions inherent in the design of special-purpose processors, or the like, that perform particular tasks or implement particular abstract data types. Processor-executable instructions, associated data structures, and program modules represent examples of the program code means for executing steps of the systems and methods disclosed herein. The particular sequence of such executable instructions or associated data structures represents examples of corresponding acts for implementing the functions described in such steps and variations in the combinations of processor-executable instructions and sequencing are within the teachings presented herein.

Figure 9:
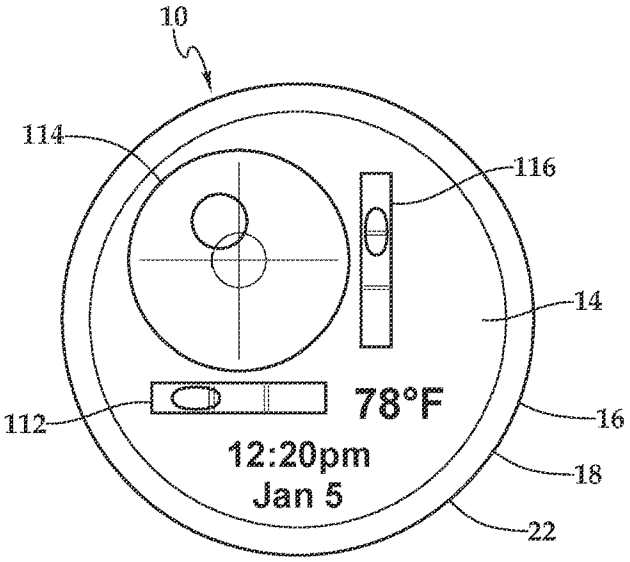
FIG. 9 is a top plan view of a further embodiment of a golf ball marker, according to the teachings presented herein.

Referring to FIG. 9, in a further embodiment of a golf ball marker 10, as previously discussed, the golf ball marker 10 includes the housing 12 having the upper surface 14, the lower surface 16, and the sidewall 18. In the illustrated embodiment, a single display 110 is utilized on the upper surface 14 with an analog presentation or format. As shown, level bubbles 112, 114, 116 show slope with date and time being shown also as part of the data 50. It should be appreciated, however, that other layouts of the data 50 for the golf ball marker 10 are within the teachings of the present invention and the exact layout and data types selected will depend on a variety of factors and application requirements.

Figure 10:
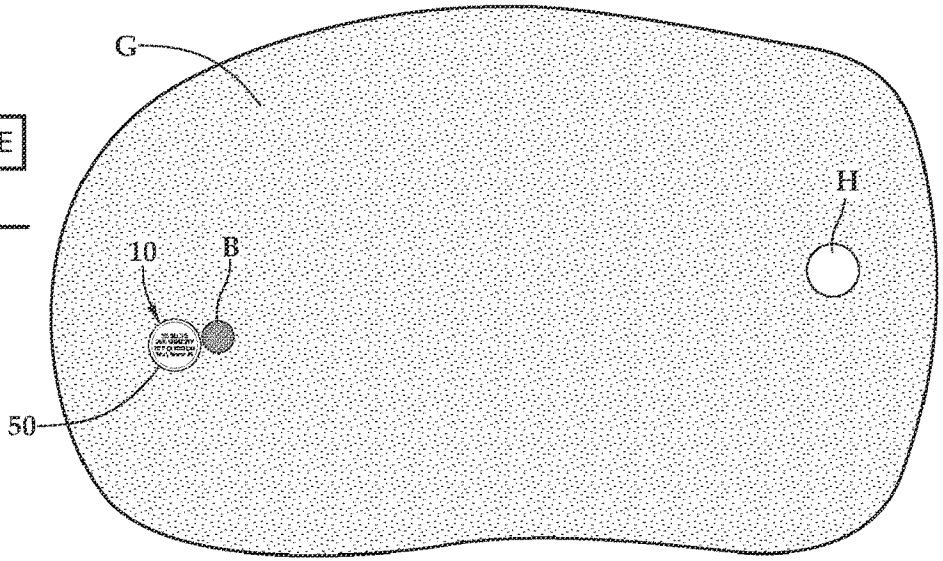
FIG. 10 is a top plan view of a golf green on which the golf ball marker of FIG. 1 is being utilized during a round of golf, according to the teachings presented herein.
Figure 11:
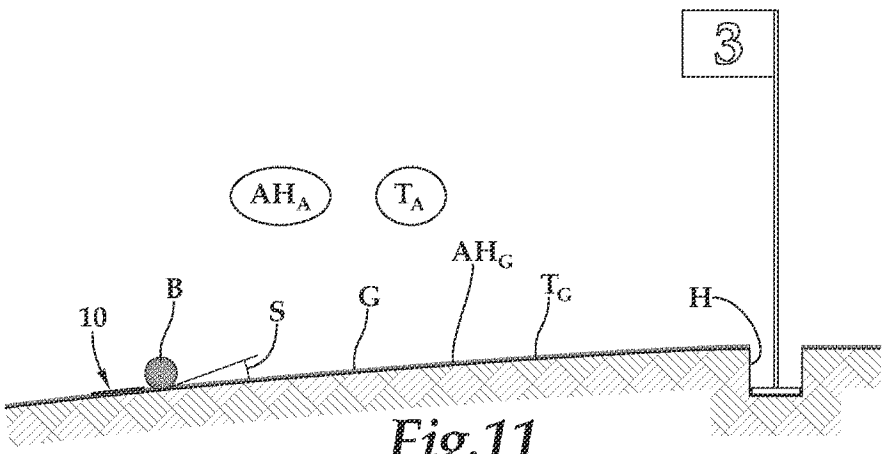
FIG. 11 is a cross-sectional view of the golf green presented in FIG. 10.

Referring to FIG. 10 and FIG. 11, some operational embodiments of the golf ball marker 10 are depicted with the golf ball marker 10 next to a golf ball B being utilized on a golf green G having a hole H with a slope S of 6% at the golf ball marker 10 with the slope heading uphill toward the hole H, as shown up the visual indicator 100 showing the slope heading uphill and the visual indicator 102 showing the slope heading downhill. The temperature of the air ($T_A$) and ground ($T_G$) is 72° F. The humidity of the air ($AH_A$) is 40% and the humidity of the ground ($AH_G$) is 95% as the surface is wet. With the data 50 displayed on the golf ball marker 10, the golfer may use the data 50 to inform a put and improve the putting.

Relative terms, such as, but not limited to, "upper," or "lower," may be used herein to describe one element's relationship to another element as illustrated in the figures. Such relative terms are intended to encompass different orientations of the device in addition to the orientation depicted in the figures. Further, the order of execution or performance of the methods and process flows illustrated and described herein is not essential, unless otherwise specified. That is, elements of the methods and process flows may be performed in any order, unless otherwise specified, and that the methods may include more or less elements than those disclosed herein. For example, it is contemplated that executing or performing a particular element before, contemporaneously with, or after another element are all possible sequences of execution.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A golf ball marker comprising:

a housing having an upper surface, a lower surface, and a sidewall interposed therebetween, the housing being a disc shape with a flush finish;

an upper display integrated into the housing, the upper display being visible at the upper surface, the upper display having an upper perimeter;

a lower display integrated into the housing, the lower display being visible at the lower surface, the lower display having a lower perimeter;

a processor, memory, a temperature sensor, a humidity sensor, and an inclinometer communicatively interconnected in a busing architecture with the upper display and the lower display;

the temperature sensor including an upper temperature sensor disposed proximate the upper surface and a lower temperature sensor disposed proximate the lower surface; and the memory being accessible to the processor, the memory including processor-executable instructions that, when executed by the processor, cause the processor to:

display a date and time on the upper display and the lower display, display a temperature reading from the temperature sensor on the upper display and the lower display, display a slope reading from the inclinometer on the upper display and the lower display, visually indicate a direction associated with the slope reading at the upper perimeter and the lower perimeter, and display a humidity reading from the humidity sensor on the upper display and the lower display.

2. The golf ball marker as recited in claim 1, wherein the inclinometer further comprises a hygrometer.

3. The golf ball marker as recited in claim 1, wherein the temperature sensor is capable of measuring both air temperature and ground temperature.

4. The golf ball marker as recited in claim 1, wherein the processor-executable instructions further cause the processor to toggle, on the upper display and the lower display, between presentation of the date and time, the temperature reading, the slope reading, and the humidity reading.

5. The golf ball marker as recited in claim 1, wherein each of the upper display and the lower display have a digital presentation mode.

6. The golf ball marker as recited in claim 1, wherein each of the upper display and the lower display have an analog presentation mode.

7. The golf ball marker as recited in claim 1, wherein the processor-executable instructions further cause the processor to display, as part of the slope reading, at least one of a slope percentage and a slope direction on the upper and lower displays.

8. The golf ball marker as recited in claim 1, wherein the processor-executable instructions further cause the processor to display, as part of the slope reading, a slope percentage and a slope direction as separate values on the upper and lower displays.

9. The golf ball marker as recited in claim 1, wherein the processor-executable instructions further cause the processor to:

visually indicate with a first visual indicator an uphill slope direction associated with the slope reading at the upper perimeter and the lower perimeter, and visually indicate with a second visual indicator a downhill slope direction associated with the slope reading at the upper perimeter and the lower perimeter, the first visual indicator and the second visual indicator being visually distinct.

10. The golf ball marker as recited in claim 1, wherein the humidity sensor further comprises an upper humidity sensor disposed proximate the upper surface and a lower humidity sensor disposed proximate the lower surface.

11. The golf ball marker as recited in claim 1, wherein the humidity sensor is capable of measuring both air humidity and ground humidity.

12. The golf ball marker as recited in claim 1, wherein the humidity sensor further comprises a hygrometer.

13. The golf ball marker as recited in claim 1, wherein the humidity sensor further comprises a sensor selected from the group consisting of capacitive, resistive, and thermal.

14. A golf ball marker comprising:

a housing having an upper surface, a lower surface, and a sidewall interposed therebetween, the housing being a disc shape with a flush finish;

an upper display integrated into the housing, the upper display being visible at the upper surface, the upper display having an upper perimeter;

a lower display integrated into the housing, the lower display being visible at the lower surface, the lower display having a lower perimeter;

a processor, memory, a temperature sensor, a humidity sensor, and an inclinometer communicatively interconnected in a busing architecture with the upper display and the lower display; and the memory being accessible to the processor, the memory including processor-executable instructions that, when executed by the processor, cause the processor to:

display a date and time on the upper display and the lower display, display a temperature reading from the temperature sensor on the upper display and the lower display, display a slope reading from the inclinometer on the upper display and the lower display, the slope reading including a slope percentage and a slope direction as separate values on the upper and lower displays, visually indicate a direction associated with the slope reading at the upper perimeter and the lower perimeter, and display a humidity reading from the humidity sensor on the upper display and the lower display.

15. A golf ball marker comprising:

a housing having an upper surface, a lower surface, and a sidewall interposed therebetween, the housing being a disc shape with a flush finish;

an upper display integrated into the housing, the upper display being visible at the upper surface, the upper display having an upper perimeter;

a lower display integrated into the housing, the lower display being visible at the lower surface, the lower display having a lower perimeter;

a processor, memory, a temperature sensor, a humidity sensor, and an inclinometer communicatively interconnected in a busing architecture with the upper display and the lower display;

the humidity sensor including an upper humidity sensor disposed proximate the upper surface and a lower humidity sensor disposed proximate the lower surface; and the memory being accessible to the processor, the memory including processor-executable instructions that, when executed by the processor, cause the processor to:

display a date and time on the upper display and the lower display, display a temperature reading from the temperature sensor on the upper display and the lower display, display a slope reading from the inclinometer on the upper display and the lower display, visually indicate a direction associated with the slope reading at the upper perimeter and the lower perimeter, and display a humidity reading from the humidity sensor on the upper display and the lower display.

* * * * *